US007038556B2

(12) United States Patent
An et al.

(10) Patent No.: US 7,038,556 B2
(45) Date of Patent: May 2, 2006

(54) WAVEGUIDE TYPE SIGNAL TERMINATOR AND SIGNAL ATTENUATOR

(75) Inventors: Jae We An, Ulsan-si (KR); Young Geun Yoo, Ulsan-si (KR)

(73) Assignee: ComoTech Corporation, Ulsan (KR)

( * ) Notice: Subject to any disclaimer, the term of this patent is extended or adjusted under 35 U.S.C. 154(b) by 50 days.

(21) Appl. No.: 10/803,992

(22) Filed: Mar. 19, 2004

(65) Prior Publication Data

US 2005/0162235 A1 Jul. 28, 2005

(30) Foreign Application Priority Data

Jan. 27, 2004 (KR) ..... 10-2004-0005076

(51) Int. Cl.
*H01P 1/22* (2006.01)

(52) U.S. Cl. ..... 333/81 B; 333/22 R; 333/239; 333/248

(58) Field of Classification Search ..... 333/81 B, 333/22 R, 248, 239, 251
See application file for complete search history.

(56) References Cited

U.S. PATENT DOCUMENTS 5,920,245 A * 7/1999 Ishikawa et al. ..... 333/248
6,094,106 A * 7/2000 Kishino et al. ..... 333/22 R
6,580,343 B1 * 6/2003 Saitoh et al. ..... 333/239
6,870,449 B1 * 3/2005 Kitamori et al. ..... 333/251

FOREIGN PATENT DOCUMENTS

JP 11-136010 5/1999
JP 2001-16003 1/2001

* cited by examiner

*Primary Examiner*—Stephen E. Jones
(74) *Attorney, Agent, or Firm*—Nixon Peabody LLP

(57) ABSTRACT

Disclosed are a waveguide type signal attenuator for attenuating an input signal as desired and a waveguide type signal terminator for making an input signal be utterly disappeared, where a manufacturing-easy resistor sheet is inserted into the center area, along which a traveling electromagnetic wave has the maximum intensity, of the signal attenuator and the signal terminator. In the signal terminator and the signal attenuator, a predetermined part of the waveguide which is formed in a lower conductive plate is expanded out along the half-height plane of the waveguide to form a resistor sheet setting groove and a portion of the elongated cavity positioned behind the resistor sheet setting groove forms a lower half of the waveguide. In addition, a resistor sheet is inserted between the resistor sheet setting groove and a protrusion part which protrudes from an upper conductive plate, of the half-height of the waveguide holds the resistor sheet to form an upper half portion of the waveguide. That is, the resistor sheet installed in the center area of the waveguide can give the desired attenuation or termination of an input signal.

4 Claims, 10 Drawing Sheets

WAVEGUIDE TYPE SIGNAL TERMINATOR AND SIGNAL ATTENUATOR

BACKGROUND OF THE INVENTION

1. Field of the Invention

The present invention relates to a waveguide type signal terminator and signal attenuator which can be used as an element for wireless communication systems and measuring apparatuses. More particularly, the present invention relates to a waveguide type signal attenuator for attenuating an input signal to a desired state and a waveguide type signal terminator for making an input signal be vanished in which a resistor sheet acting for signal attenuation or termination is inserted into the central area of the waveguide, along which a traveling electromagnetic wave has the strongest intensity, of the signal attenuator and the signal terminator.

2. Description of Prior Art

Recently, in order to realize a wireless communication of very high speed and massive capacity of data traffic, many tries for a wireless communication have been made by means of transmitter/receiver in a band of millimeter wavelength. In wireless communication systems used in the band of millimeter wavelength, such systems using small loss waveguides are widely used and waveguides are also broadly employed by a variety kind of elements and measuring apparatuses. In such wireless communication systems and measuring apparatuses, there are many cases that signal attenuation or signal termination is required. In those cases, needed are an attenuator which makes an input signal be attenuated by a certain ratio into and/or a signal terminator which makes an input signal be completely terminated. An example for a prior signal attenuator and a prior signal terminator is illustrated in FIGS. 1A to 2B.

FIGS. 1A and 1B are perspective views which show an example of a prior waveguide type terminator, showing one state that an absorbing body is installed and another state that the absorbing body is detached.

According to the structure of the prior waveguide type signal terminator 1 as shown in drawings, a waveguide 12 of an elongated cavity line structure of which an exit is closed is formed in a lower conductive plate 10 and the open top of the waveguide 12 is covered with an upper conductive plate 30. In addition, in the waveguide 12, an absorbing body 20 is installed. In order to secure a function of the signal terminator 1 which attenuates an input signal and terminates it finally, the output port of the waveguide 12 is closed. In the front portion of the absorbing body 20, a V-groove 22 is formed with its vertex orienting to the rear of the absorbing body 20. The absorbing body 20 is usually made from raw materials of a ceramic system.

The signal terminator 1 with such a structure as above is required to have a function of signal absorbing so that an input signal entering a signal input port 14 can be completely disappeared without causing any reflection of the input signal at the end portion of the signal terminator 1. In order to meet this requirement of no signal reflection in the signal terminator, there should be given an impedance match between a waveguide portion inserted with the absorbing body 20 and its neighboring waveguide portion. The impedance match can be obtained by making the length $d_1$ of V-groove 22 be equal to the wavelength-in-waveguide μg of the input signal. Besides, a signal absorbing rate by the absorbing body 20 can be adjusted by varying the length $d_2$ of the rear portion behind the V-groove 22 of the absorbing body 20. The signal absorbing ratio increases in proportion to the length $d_2$ of the rear portion behind the V-groove 22, but it is saturated over a threshold value.

To obtain a good characteristic of the signal terminator 1 as such, accurate works are needed in designing and manufacturing the absorbing body 20, particularly as to the length $d_1$ of V-groove and the length $d_2$ of the rear portion. There are some difficulties in manufacturing the prior signal terminator 1 which requires accurate manufacturing works, and thus such requirement pushes up the manufacturing cost.

Meanwhile, FIGS. 2A and 2B are perspective views which illustrate a prior waveguide type signal attenuator, where FIG. 2A shows a state that a resistor card is installed and FIG. 2B shows a state that the resistor card is detached.

According to the prior waveguide type signal attenuator 3 as shown in FIGS. 2A and 2B, a waveguide 52 of an elongated cavity of which both ends for input and output are opened is formed in a lower conductive plate 50 and the open top of the waveguide 52 is covered with an upper conductive plate 70. In addition, in the waveguide 52, a resistor card 60 is installed. The resistor card 60 resembles a semi elliptical shape of which height becomes smoothly lower from center to both ends. The resistor card 60 having the semi elliptical shape gives an impedance match between two sections, where one section is installed with the resistor card 60 and the other section is not, of the waveguide 52 so that it can effectively suppress the signal reflection. That is, an input signal inputted to a signal input port 54 of the waveguide 52 is attenuated by the resistor card 60 and the attenuated input signal is outputted through a signal output port 56.

An intensity of electric field of the input signal has the maximum value along the center area of the waveguide 52, that is, along the bisecting line of the width of the waveguide 52 and thus the resistor card 60 is located along the bisecting line to obtain the best impedance match and the maximum signal attenuation ratio. For the installation of the resistor card 60, the waveguide 52 is formed with an insertion groove 58 having the same thickness with the resistor card 60 and the resistor card 60 is inserted into and fixed to the insertion groove 58.

A signal attenuation ratio is determined in accordance with a projected area of the resistor card 60 which is inserted into the waveguide 52. In order to obtain a required signal attenuation ratio, an insertion depth of the resistor card 60 into the insertion groove 58 should be suitably determined to adjust the projected area of the resistor card 60 which projects into the waveguide 60. However, the signal attenuator 3 having such a structure has some defects that it is difficult to determine an accurate position at which the resistor card 60 is installed to obtain a precise signal attenuation ratio and is also not easy to form the insertion groove 58 for the resistor card.

SUMMARY OF THE INVENTION

To improve the above defects, the present invention has a first object to provide a waveguide type signal terminator of simple structure and improved-construction-easiness in which a fabrication-easy resistor sheet can be simply and easily positioned at the center area of the waveguide, where an electric field has the strongest intensity, by setting the resistor sheet between upper and lower conductive plates.

The present invention has a second object to provide a waveguide type attenuator of simple structure and improved-construction-easiness in which a fabrication-easy resistor sheet can be simply and easily positioned at the center of the waveguide, where an electric field has the strongest intensity, by setting the resistor sheet between upper and lower conductive plates.

To accomplish the first object of the present invention, there is provided a waveguide type signal terminator which includes a conductive housing, constructed by combining a lower conductive plate and an upper conductive plate into a single body and formed therein with a waveguide of an elongated cavity of which an entrance is opened and an exit is closed; and a resistor sheet, formed with V-groove at a signal input side thereof and placed between the lower conductive plate and the upper conductive plate so as to divide the waveguide, in a direction of length and at a half-level of the waveguide, along a section from a position spaced a predetermined distance apart from the entrance of the waveguide to the exit of the waveguide, for terminating an input signal applied into the signal input side through the entrance of the waveguide.

To accomplish the second object of the present invention, there is provided a waveguide type signal attenuator which comprises a conductive housing, constructed by combining a lower conductive plate and an upper conductive plate into a single body and formed therein with a waveguide of an elongated cavity of which an entrance and an exit are opened; and a resistor sheet, formed with two opposite V-grooves at a signal input side and a signal output side thereof, respectively, and placed between the lower conductive plate and the upper conductive plate so as to divide the waveguide along a section between the entrance and the exit of the waveguide, in a direction of length and at a half-level of the waveguide, for attenuating an input signal applied into the signal input side through the entrance of the waveguide and outputting an attenuated input signal to the signal output side.

BRIEF DESCRIPTION OF THE DRAWINGS

The detailed description relating to the preferred embodiments of the present invention will be made with reference to the accompanying drawings.

DETAILED DESCRIPTION OF THE PREFERRED EMBODIMENTS

Hereinafter, the preferred embodiments of the present invention will be explained in detail with reference to the accompanying drawings.

Figure 1A:
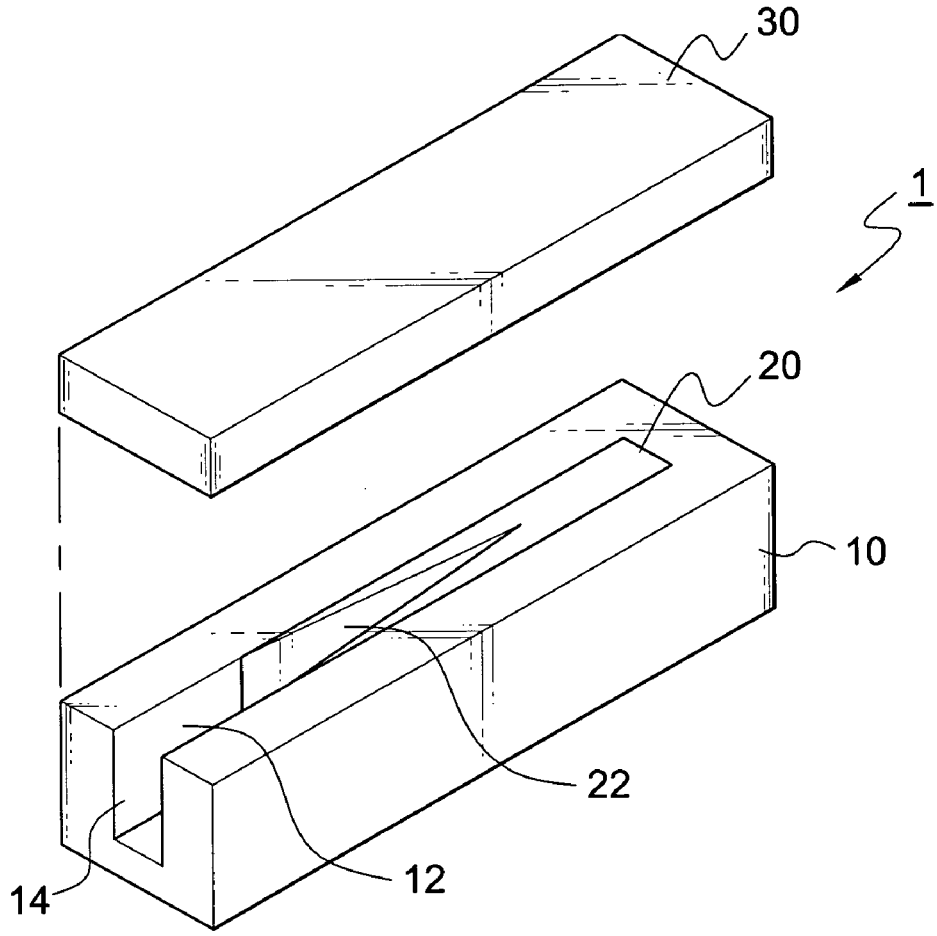
FIG. 1A (PRIOR ART)
FIGS. 1A and 1B are perspective views which show an example of a prior waveguide type signal terminator.
Figure 1B:
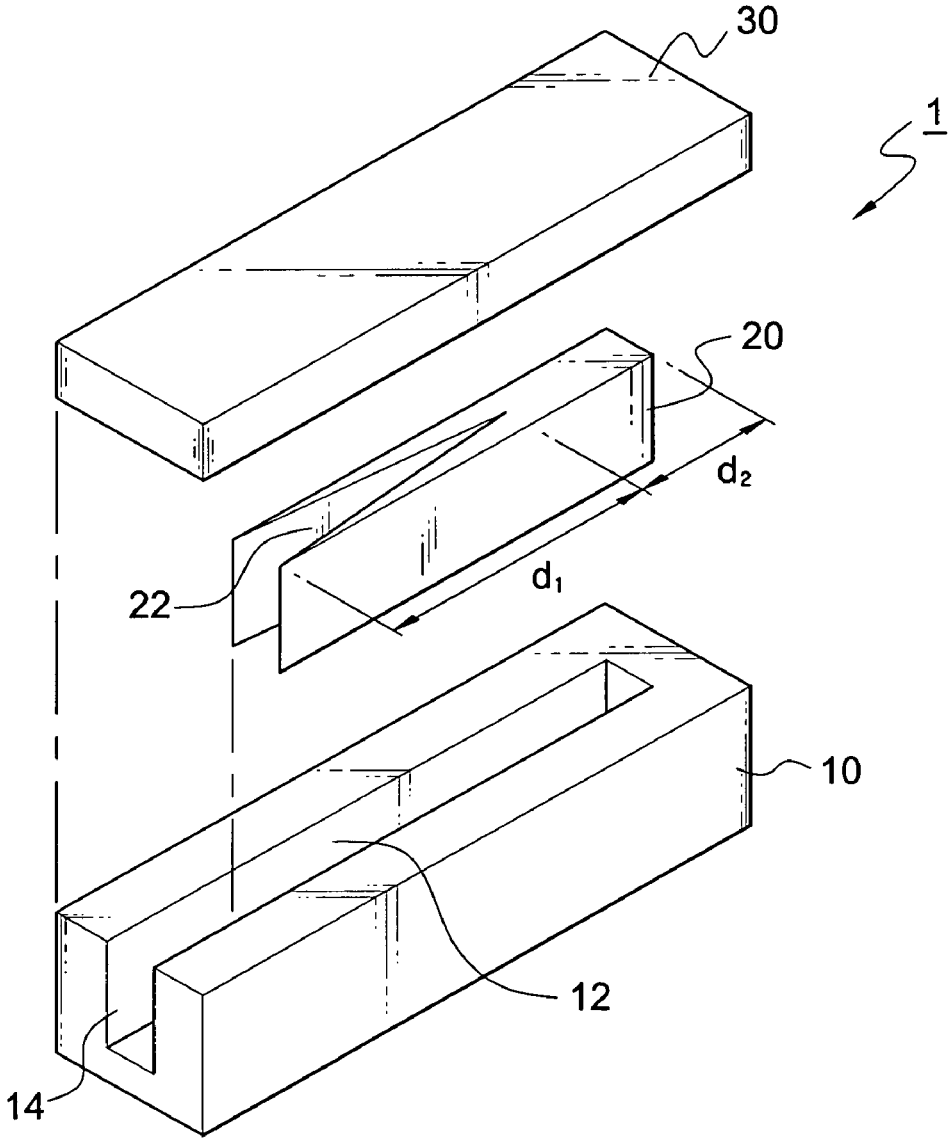
FIG. 1B (PRIOR ART)
Figure 2A:
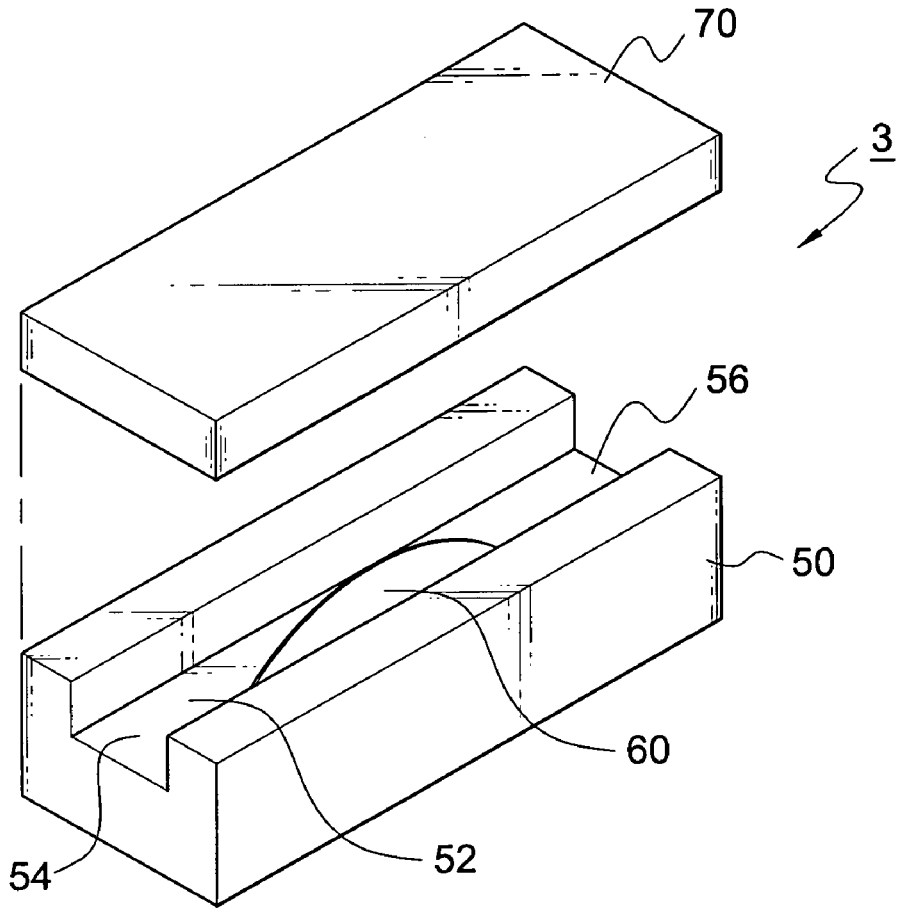
FIG. 2A (PRIOR ART)
FIGS. 2A and 2B are perspective views which show an example of a prior waveguide type signal attenuator.
Figure 2B:
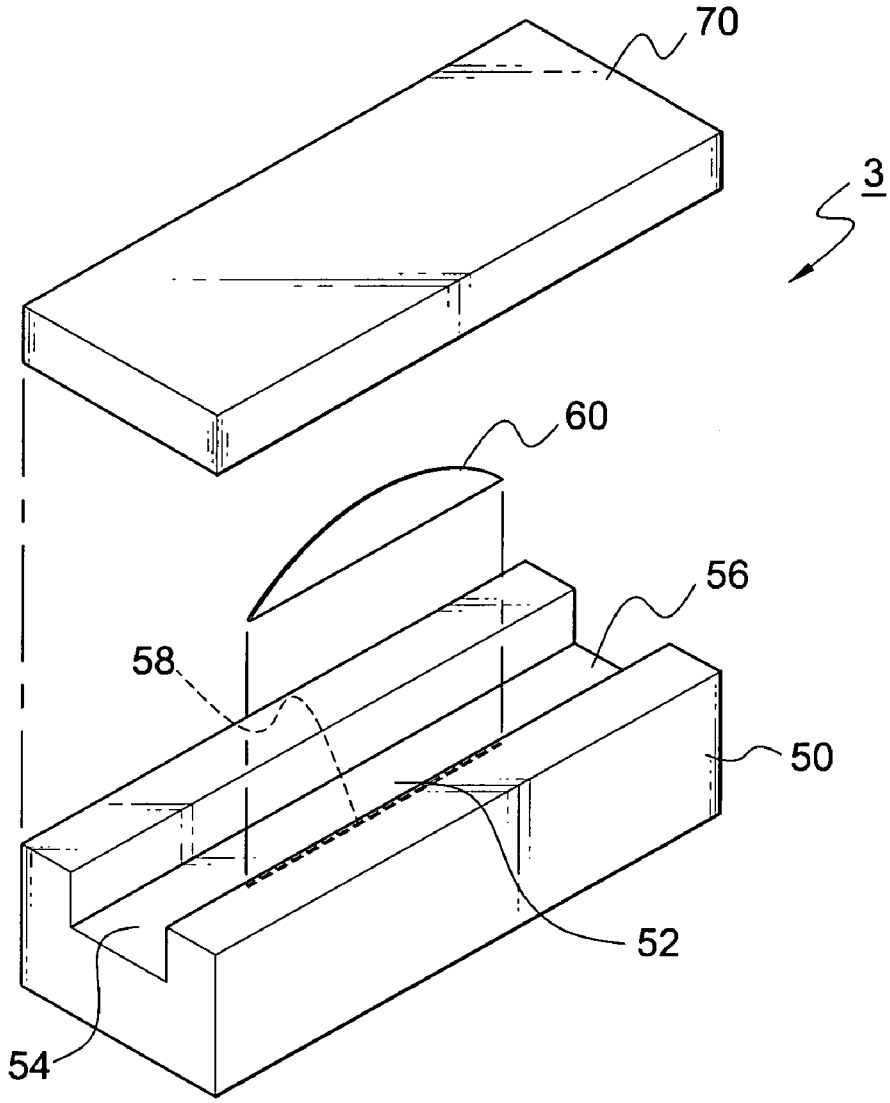
FIG. 2B (PRIOR ART)
Figure 3A:
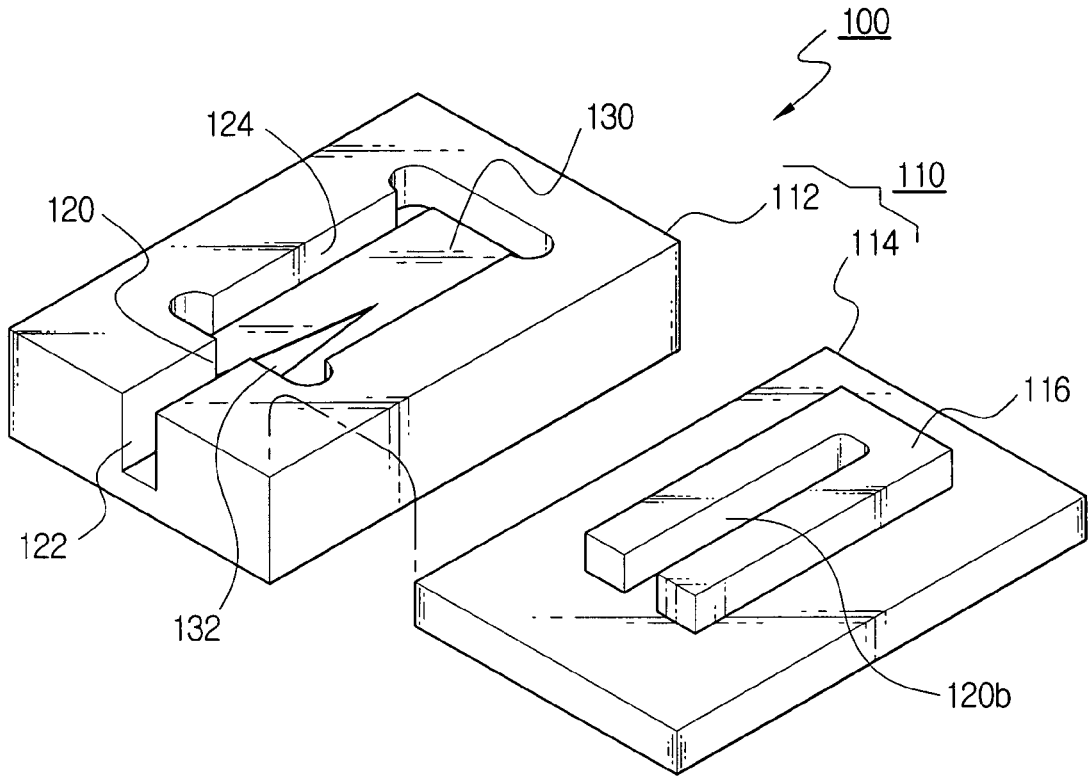
FIGS. 3A and 3B are perspective views which show an embodiment of a waveguide type signal terminator in accordance with the present invention.
Figure 3B:
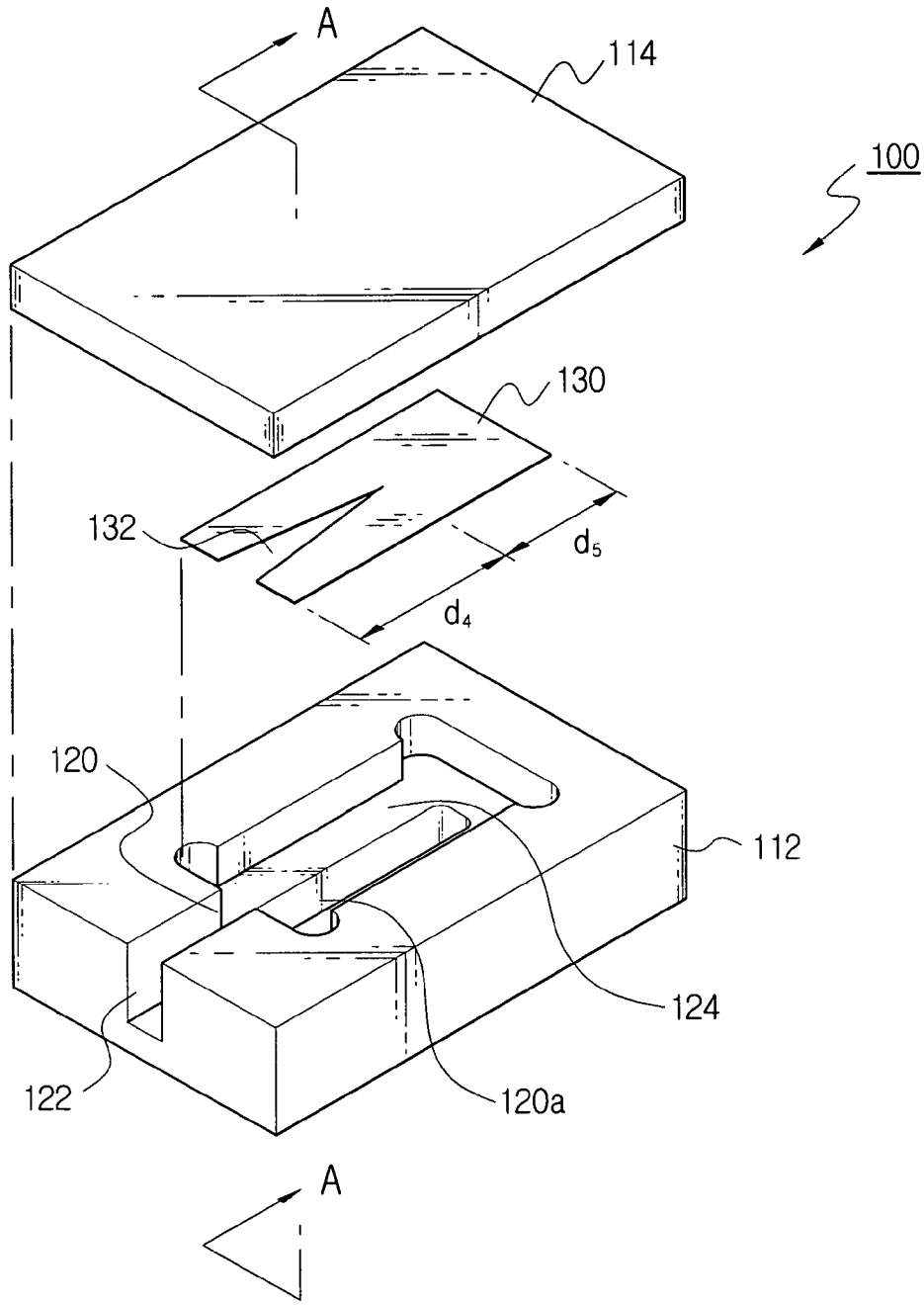
Figure 4:
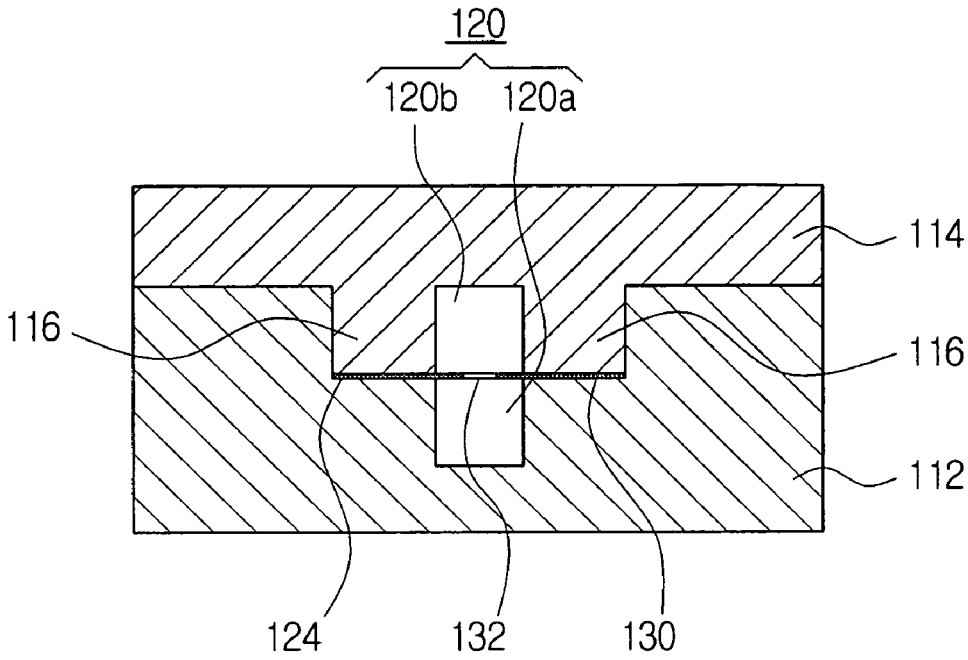
FIG. 4 is a cross-sectional view along line A—A in FIG. 3B for the signal terminator assembled.

An example of a waveguide type signal terminator, which is applicable for wireless communication systems and measuring apparatuses, in accordance with the present invention is shown in FIGS. 3A and 3B. Particularly FIG. 3A shows an assembled signal terminator in which a resistor sheet is installed and FIG. 3B shows a dissembled signal terminator. FIG. 4 is a cross-sectional view along line A—A in FIG. 3B for the signal terminator assembled.

In the signal terminator 100 of the present invention, a waveguide 120 is formed by making an elongated cavity line which extends toward inside of a conductive housing 110 from a lateral side of the conductive housing 110. In view of the characteristic of the signal terminator 100, one end of the signal terminator 100 is opened to become a signal input port 122 and the opposite end of the signal terminator 100 is closed not to provide a signal output port. That is, the length of waveguide 120 is shorter than that of the conductive housing 110 and the waveguide 120 has an open entrance into which a signal can be inputted from outside but not an exit by shutting up the end portion with conductive material. In addition, a resistor sheet 130 is located along a section from a position spaced a predetermined distance apart from the entrance to a position going a little beyond the end of the waveguide 120 in a manner that it cuts the waveguide 120 along the half-level line of the waveguide 120. The resistor sheet 130 has a width wider than that of the waveguide 120 and is formed with a V-groove 132 of a predetermined length $d_4$ in a manner that the mouth and the vertex of the V-groove 132 are oriented toward the entrance and the exit of the waveguide 120, respectively. It is preferable that the width of the mouth of the V-groove 132 is substantially equal to the width of the waveguide 120.

An exemplary method for manufacturing the signal terminator is explained hereinafter with reference to the attached drawings. As shown in FIGS. 3A, 3B & 4, to secure fabrication easiness for the waveguide 120, the conductive housing 110 consists of a lower conductive plate 112 which has a depth deeper than the height of the waveguide 120 and an upper conductive plate 114 coupled to the lower conductive plate 112. In the topside of the lower conductive plate 112, a resistor sheet setting groove 124 is formed for receiving the resistor sheet 130. In addition, to place the resistor sheet 130 at a half-height of the waveguide 120, the resistor sheet setting groove 124 is also made to have a depth substantially equal to the half-height of the waveguide 120.

In addition, an elongated cavity of a half-height of the waveguide 120 is further formed, where the cavity extends from the farthest end of the floor of the resistor sheet setting groove 124, toward a direction of length, to penetrate to one lateral side of the lower conductive plate 112, and the cavity becomes a lower waveguide 120*a*. The resistor sheet setting groove 124 has a U-shaped floor which surrounds a part of the lower waveguide 120*a*. To hold the resistor sheet 130 after normally installing the resistor sheet 130 in the resistor sheet setting groove 124, the upper conductive plate 114 has a bottom side formed with a U-shaped protrusion 116 which is opposite in shape to the U-shaped floor of the resistor sheet setting groove 124. Accordingly, when the resistor sheet 130 is inserted into the resistor sheet setting groove 124 in the lower conductive plate 112 and the upper conductive plate 114 is placed thereon as a cover, the resistor sheet holding protrusion 116 enters into the resistor sheet setting groove 124 and holds and supports the resistor sheet 130 by pressure. The waveguide 120 is not divided in a range from its entrance to the resistor sheet setting groove 124 but is divided into the lower waveguide 120*a* and the upper waveguide 120*b* by the resistor sheet 130 in a range from the resistor sheet setting groove 124 to its end.

The signal terminator 100 is a device for dissipating a signal to be utterly disappeared and thus is usually used for an isolation port of a coupler. In the signal terminator 100, the less a reflection loss which is the most important factor is, in other word, the less a reflection ratio of an input signal to the signal input port 122 is, the better the signal terminator 100 is. To minimize the reflection ratio, impedance match is required between a waveguide toward the signal input port 122 and a waveguide along which the resistor sheet 130 is installed. The impedance match can be obtained by making the input impedance of the waveguide be equal to a resistance of the resistor sheet 130 and by making the V-groove 132 be formed at the input side of the resistor sheet 130 and the length $d_4$ of the V-groove 132 be equal to the wavelength-in-waveguide λg of the input signal frequency. Besides, in order to obtain the utmost signal attenuation effect, the resistor sheet 130 is installed in the center area along which a traveling electromagnetic wave has the strongest intensity and the length $d_5$ from the vertex of the V-groove 132 to the end of the resistor sheet 130 is determined so as to make the maximum signal attenuation. The structure capable of making the maximum signal attenuation can provide an improved characteristic of the signal terminator 100 which causes the minimum reflection loss. Of course, the length $d_4$ of the V-groove 132 and the length $d_5$ may be varied to meet the requirement of yielding the minimum reflection loss.

According to the signal terminator 100 as above, the energy of a signal inputted into the signal input port 122 will be utterly dissipated by the resistor sheet 130 to be vanished completely. Merits of the illustrated signal terminator 100 are that it can be simply and easily constructed and assembled and can maximize the signal attenuation amount by simply adjusting the resistance and the length characteristic of the resistor sheet 130.

Figure 5A:
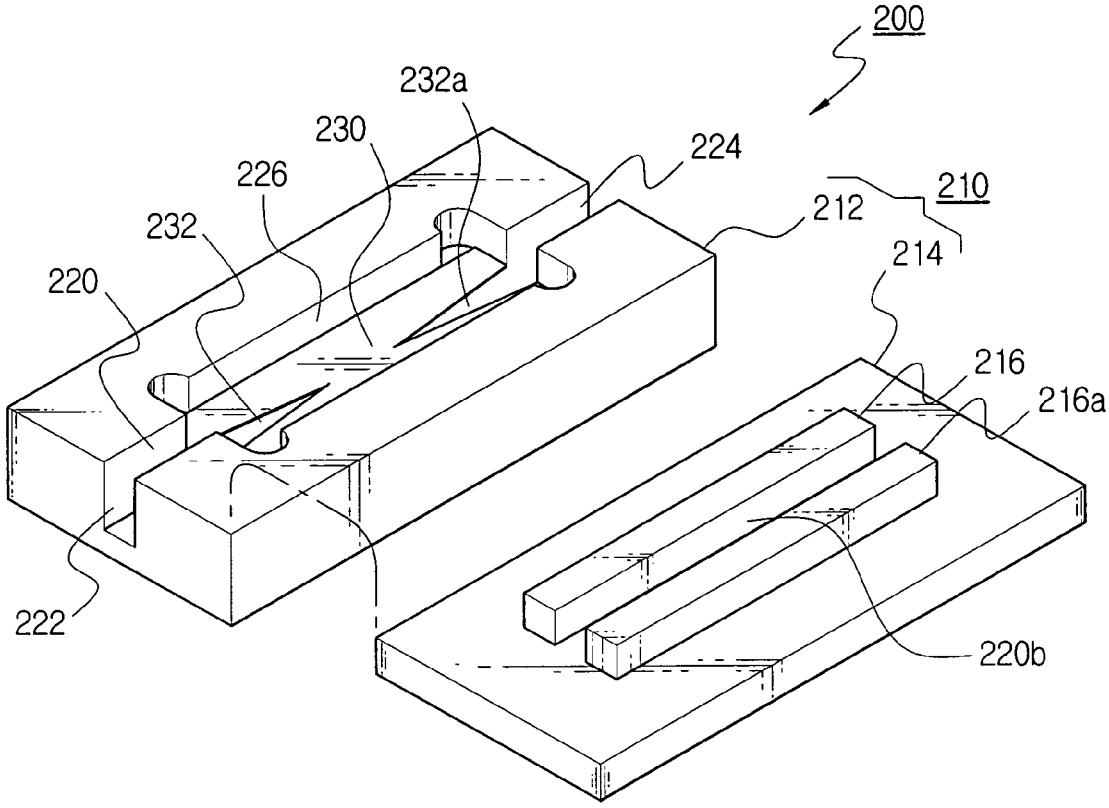
FIGS. 5A and 5B are perspective views which show an embodiment of a waveguide type signal attenuator in accordance with the present invention.
Figure 5B:
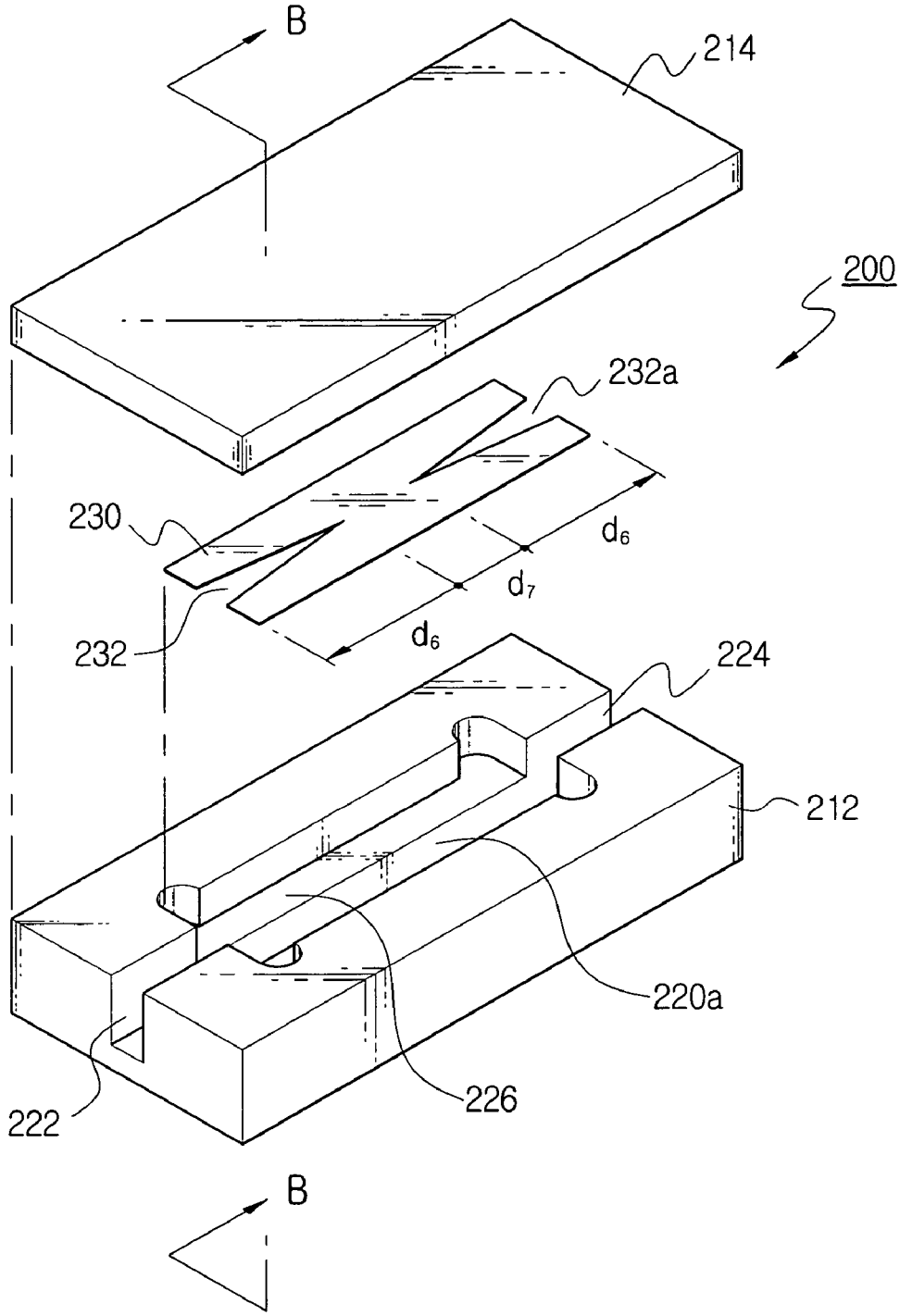
Figure 6:
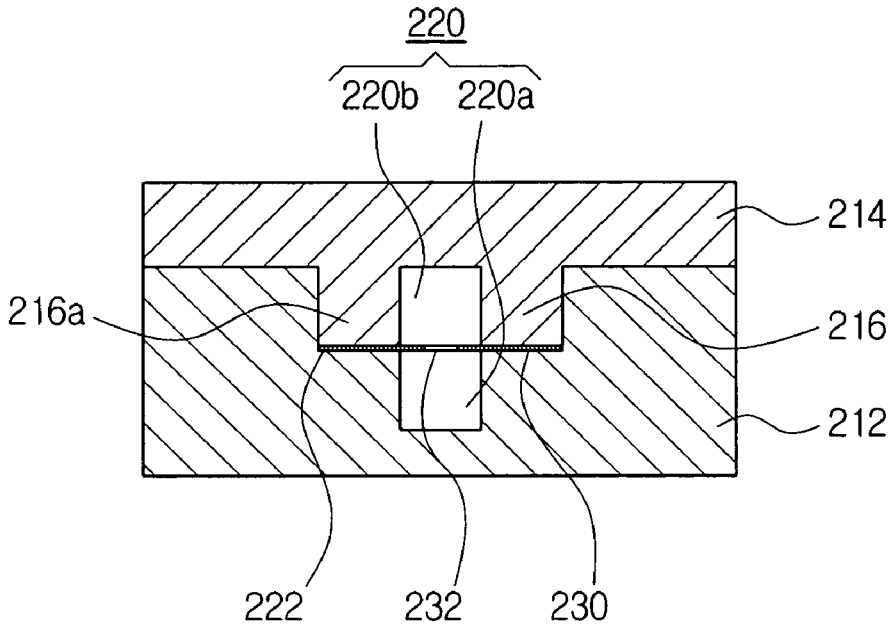
FIG. 6 is a cross-sectional view along line B—B in FIG. 5B for the signal attenuator assembled.

FIGS. 5A and 5B are perspective views which show an embodiment of a waveguide type signal attenuator in accordance with the present invention for wireless communication systems and measurement apparatuses. Particularly, FIG. 5A shows a view that a resistor sheet is installed and FIG. 5B shows a view that the resistor sheet is detached. FIG. 6 is a cross-sectional view along line B—B in FIG. 5B for the signal attenuator assembled.

In the attenuator 200 of the present invention as shown in the drawings, a waveguide 220 is formed by making an elongated cavity line which penetrates from one side to the opposite side of a conductive housing 210. In view of the characteristic of the signal attenuator 200, one open-end of the signal attenuator 200 is a signal input port 222 and the opposite open-end of the signal attenuator 200 is a signal output port 224. In addition, a resistor sheet 230 is installed in a manner that the resistor sheet 230 is placed along a section from a position spaced a predetermined distance apart from the entrance to a position a little before the end of the waveguide 220 so that it cuts the waveguide 220 along the half-level line of the waveguide 220. The resistor sheet 230 has a width wider than that of the waveguide 220 and is formed with a pair of V-grooves 232 and 232*a* which have a predetermined length $d_6$ and are located at both sides from the center position of the resistor sheet 230 with their vertexes orienting the center position of the resistor sheet 230 and facing with each other. It is preferable that the widths of the mouth of the V-grooves 232 and 232*a* are substantially equal to the width of the waveguide 220.

An exemplary method for manufacturing the signal attenuator is explained hereinafter with reference to the attached drawings. As shown in FIGS. 5A, 5B & 6, to secure fabrication easiness for the waveguide 220, the conductive housing 210 consists of a lower conductive plate 212 which has a thickness thicker than the height of the waveguide 220 and an upper conductive plate 214 coupled to the lower conductive plate 212. In the topside of the lower conductive plate 212, a resistor sheet setting groove 226 is formed for setting the resistor sheet 230. In addition, to place the resistor sheet 230 at the half-height of the waveguide 220, the resistor sheet setting groove 226 is also made to have a depth substantially equal to the half-height of the waveguide 220.

In addition, an elongated cavity of which depth is substantially equal to the half-height of the waveguide 220 is further formed, where the cavity penetrates the resistor sheet setting groove 226, in a direction of length of the resistor sheet setting groove 224, to extend to both ends of the lower conductive plate 212 and the cavity becomes a lower waveguide 220*a*. To hold the resistor sheet 230 which is normally placed in the resistor sheet setting groove 226, the upper conductive plate 214 has a bottom side with '11-shaped' two protrusions 216 and 216*a* which are opposite in shape to the resistor sheet setting groove 226. Accordingly, when the resistor sheet 230 is inserted into the resistor sheet setting groove 226 in the lower conductive plate 212 and the upper conductive plate 214 is placed thereon as a cover, the resistor sheet holding protrusions 216 and 216*a* enter into the resistor sheet setting groove 226 and then hold and support the resistor sheet 230 by pressure. The waveguide 220 is not divided in a range from its entrance to the resistor sheet setting groove 226 but is divided into the lower waveguide 220*a* and the upper waveguide 220*b* by the resistor sheet 230 in a range of the resistor sheet setting groove 226 and is not divided in a range from the exit of the resistor sheet setting groove 226 to the exit of the waveguide 220.

The signal attenuator 200 is in charge of attenuating an input signal inputted through the signal input port 222 and outputting the attenuated input signal through the signal output port 224, and is usually used as an accessory for the measuring apparatuses. Important factors for the signal attenuator 200 are not only a good characteristic of reflection loss but also an ability of providing a desired attenuation. For the good characteristic of reflection loss, impedance match is required between the waveguide portion being installed with the resistor sheet 230 and its neighboring waveguide portion. In the signal attenuator 200, since waveguides are connected with the front portion and the rear portion of the waveguide in which the resistor sheet 230 is installed, both the signal input port 222 in the front portion and the signal output port 224 in the rear portion should be matched in their impedance. For this impedance match, the input impedance Zo of the waveguide and the resistance R of the resistor sheet 230 should be equal. Furthermore, two V-grooves 232 and 232*a* of which mouths are positioned at both facing edges of the resistor sheets 230 and two vertexes of them face with each other, where the length $d_6$ of the V-grooves 232 and 232*a* is equal to the wavelength-in-waveguide λg of the input signal frequency. Here, the wavelength-in-waveguide has periodicity and thus the length $d_6$ of the V-grooves can be defined as k times of the wavelength-in-waveguide λg as follow.

$$d_6 = k\ \lambda g$$

In the signal attenuator 200 of the present invention, the resistor sheet 230 should be placed along the maximum electric field intensity traveling route in the waveguide 220, that is, the central route of the waveguide 220 and the length $d_7$ of a portion of the resistor sheet 230 between the left and the right V-grooves 232 and 232*a* should be appropriately adjusted. Here, attenuation ratio of the signal attenuator 200 has a characteristic that it increases in proportion to the length $d_7$ and the length $d_6$. When a frequency of the input signal and the desired attenuation ratio are varied, the length $d_7$ and the length $d_6$ should be also suitably adjusted corresponding to the variances.

According to the signal attenuator of the present invention, when the resistor sheet 230 is placed in the resistor sheet setting groove 226 formed in the lower conductive plate 212 and then the upper conductive plate 214 is placed to be incorporated with them, the resistor sheet holding protrusions 216 and 216*a* which are formed on the bottom surface of the upper conductive plate 214 go into the resistor sheet setting groove 226 and hold both parts of the resistor sheet 230. Accordingly, the resistor sheet 230 can be simply installed at the central route of the waveguide 220. In the signal attenuator 200 having such a structure as described, the input signal which enters the signal input port 222 is attenuated by colliding with the resistor sheet 230 and being changed into a resistance heat and then is outputted through the signal output port 224. The attenuation ratio can be easily adjusted by varying the resistance and the length of the resistor sheet 230.

As described above, the waveguide type signal attenuator and the waveguide type signal terminator have a simple structure and an excellent characteristic of signal attenuation since the waveguide is divided into two halves by simply inserting the resistor sheet and thereby an input signal being attenuated or terminated into a desired signal state. In addition, the signal attenuator and the signal terminator can give several merits such as manufacturing easiness and cost effectiveness because they can be assembled by inserting the resistor sheet into the lower waveguide which is formed in the lower conductive plate and by placing the upper conductive plate thereon. Particularly, the resistor sheet is easily fabricated so that a desired attenuation ratio can be easily obtained by using the resistor sheet.

While the present invention has been particularly shown and described with reference to a particular embodiment thereof, it will be understood by those skilled in the art that various changes and modifications can be made within the scope of the invention as hereinafter claimed. Therefore, all the changes and modifications of which the meaning or scope is equal to the scope of the claims of the present invention belong to the scope of the claims thereof.

What is claimed is:

1. A waveguide type signal attenuator, comprising:

a conductive housing, constructed by combining a lower conductive plate and an upper conductive plate into a single body and formed therein with a waveguide of an elongated cavity of which an entrance and an exit are opened; and a resistor sheet, formed with opposite V-grooves at a signal input side and a signal output side thereof, respectively, and placed between the lower conductive plate and the upper conductive plate so as to divide the waveguide along a section between the entrance and the exit of the waveguide, in a direction of length at a half-level of the waveguide, for attenuating an input signal applied into the signal input side through the entrance of the waveguide and outputting an attenuated input signal to the signal output side, wherein one of the upper and lower conductive plates is formed with a resistor sheet setting groove in which the resistor sheet is placed and the other of the upper and lower conductive plates is formed with 11-shaped resistor sheet holding protrusions which support both edges of a surface of the resistor sheet.

2. A waveguide type signal attenuator as claimed in claim 1, wherein the resistor sheet setting groove is formed between a signal input port and a signal output port in a direction of length and is widened in a direction of width at the half-level of the waveguide to be wider than the waveguide and a portion of the elongated cavity positioned behind the resistor sheet setting groove forms the lower waveguide; and the resistor sheet holding protrusions comprises a pair of protrusions in which a left protrusion and a right protrusion are spaced a predetermined width apart from each other and are opposite in shape to the resistor sheet setting groove so as to support both sides of the resistor sheet and a upper waveguide which corresponds to an upper half of the waveguide is formed between legs of the legs of 11-shaped resistor sheet holding protrusions.

3. A waveguide type signal attenuator as claimed in claim 1, wherein a signal attenuation ratio of the signal attenuator is adjusted by varying a gap between the pair of V-grooves.

4. A waveguide type signal attenuator as claimed in claim 1 or 3, wherein a resistance value of the resistor sheet is equal to an input impedance of the waveguide and a length of V-groove is equal to a wavelength-in-waveguide of the input signal frequency.

* * * * *